US008359880B2

(12) United States Patent
Lee et al.

(10) Patent No.: US 8,359,880 B2
(45) Date of Patent: Jan. 29, 2013

(54) FAN MOTOR ASSEMBLY FOR BLOWING COOLING AIR AND REFRIGERATOR HAVING THE SAME

(75) Inventors: Dong-Il Lee, Seoul (KR); Jun-Ho Bae, Seoul (KR); Hyoun-Jeong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 283 days.

(21) Appl. No.: 12/513,478

(22) PCT Filed: Oct. 17, 2007

(86) PCT No.: PCT/KR2007/005074

§ 371 (c)(1),
(2), (4) Date: May 4, 2009

(87) PCT Pub. No.: WO2008/056892

PCT Pub. Date: May 15, 2008

(65) Prior Publication Data

US 2010/0064719 A1 Mar. 18, 2010

(30) Foreign Application Priority Data

Nov. 6, 2006 (KR) ..... 10-2006-0109112

(51) Int. Cl.
*F25D 17/06* (2006.01)

(52) U.S. Cl. ..... 62/419; 62/404; 62/407; 62/414

(58) Field of Classification Search ..... 62/419, 62/404, 407, 414

See application file for complete search history.

(56) References Cited

U.S. PATENT DOCUMENTS

| | | | | | |
|---|---|---|---|---|---|
| 3,050,956 | A * | 8/1962 | Mann et al. | 62/283 |
| 3,216,217 | A * | 11/1965 | Kesling | 62/289 |
| 3,261,173 | A * | 7/1966 | Gould | 62/156 |
| 3,403,533 | A * | 10/1968 | Bollenbacher | 62/408 |
| 4,086,785 | A * | 5/1978 | Kochendorfer et al. | 62/414 |
| 5,026,476 | A * | 6/1991 | Ishimoto et al. | 210/89 |
| 5,531,267 | A * | 7/1996 | Ahmed et al. | 165/124 |
| 5,699,854 | A * | 12/1997 | Hong | 165/121 |
| 5,860,281 | A * | 1/1999 | Coffee et al. | 62/3.62 |
| 6,388,196 | B1 * | 5/2002 | Liu et al. | 174/135 |
| 6,772,606 | B2 * | 8/2004 | Kopf et al. | 62/419 |
| 6,942,471 | B2 * | 9/2005 | Weisser | 417/423.1 |
| 7,174,952 | B1 * | 2/2007 | Hong et al. | 165/122 |

FOREIGN PATENT DOCUMENTS

| | | | |
|---|---|---|---|
| JP | 58088494 | A * | 5/1983 |
| JP | 09270975 | A * | 10/1997 |
| JP | 2003-009470 | | 1/2003 |
| JP | 2003009470 | A * | 1/2003 |
| KR | 1990-0002707 | | 3/1990 |
| KR | 1999-0031157 | | 5/1999 |
| KR | 2000-0056265 | | 9/2000 |
| KR | 2002022184 | A * | 3/2002 |

* cited by examiner

OTHER PUBLICATIONS

International Search Report dated Jan. 14, 2008.

*Primary Examiner* — Ljiljana Ciric
*Assistant Examiner* — Thomas Y Ho
(74) *Attorney, Agent, or Firm* — KED & Associates, LLP

(57) ABSTRACT

A fan motor assembly and a refrigerator having the same are provided. The fan motor assembly may include a cover plate having a cool air suction opening formed therein, and at least one cool air duct flow path formed at an inner side wall of the refrigerator. A blower may be provided at an interior side of the cover plate to direct cool air into the at least one cool air duct flow path.

14 Claims, 4 Drawing Sheets

FAN MOTOR ASSEMBLY FOR BLOWING COOLING AIR AND REFRIGERATOR HAVING THE SAME

TECHNICAL FIELD

The present invention relates to a refrigerator and, more particularly, to a cool air supplying fan motor assembly for supplying cool air to a storage space of a refrigerator, and a refrigerator having the cool air supplying fan motor assembly.

BACKGROUND ART

A refrigerator is a device for refrigerating or freezing food items to keep them in storage freshly. The refrigerator includes storage spaces such as a refrigerating chamber and a freezing chamber for keeping the food items in storage and a cool air supplying fan motor assembly for forcibly forcibly supplying cool air to the storage spaces.

In general, in the cool air supplying fan motor assembly installed within the refrigerator to supply cool air in the refrigerator, for example, a rotor of a motor and a fan may be integrally configured. This is to reduce an installation space of the fan motor assembly for supplying cool air, to thus increase the capacity of the storage space of the refrigerator.

However, among an inner rotor type and an outer rotor type which are classified by the position of a rotor combined with the fan, application of the inner rotor type has a limitation in increasing the capacity of the storage space of the refrigerator. In addition, in the fan motor assembly for supplying cool air, generally, an axial flow fan is used as the fan, which degrades the efficiency of supplying cool air, compared with application of a centrifugal fan. Also, when the axial flow fan is used, an electric wire for supplying power to the motor is inevitably exposed to a cool air flow path to act as resistance to a flow of cool air.

In addition, generally, the cool air supplying fan motor assembly is fixedly installed on a wall body of the refrigerator. This causes vibration and noise generated from the motor to be transferred to the exterior via the wall body, making the user feel uncomfortable and inconvenient in using the product.

TECHNICAL GIST OF THE PRESENT INVENTION

Therefore, it is an object of the present invention to provide a cool air supplying fan motor assembly capable of increasing the capacity of a storage space by making the fan motor assembly compact, preventing an electric wire connected with a motor from interfering with a flow of cool air, and minimizing transmission of vibration and noise according to driving of the motor, and a refrigerator having the same.

To achieve the above object, in one aspect, a cool air supplying fan motor assembly includes: a cover plate having a cool air suction opening communicating with a cool air duct flow path formed at an inner side of a wall surface of a refrigerator and combined with the wall surface of the refrigerator; and a blowing unit combined with a rear surface of the cover plate and discharging cool air which has been sucked into the cool air suction opening to the cool air duct flow path.

The blowing unit may be accommodated in a blowing unit accommodating part formed at the inner side of the wall surface of the refrigerator and communicating with the cool air duct flow path.

An orifice may be formed around the cool air suction opening to allow cool air to be smoothly sucked into the blowing unit.

The cool air suction opening may suck cool air generated from an evaporator provided at one side of the wall surface on which the cover plate is combined.

An elastic member may be interposed between the cover plate and the inner wall surface of the refrigerator.

The blowing unit may include: a centrifugal fan that discharges cool air, which has been sucked into the cool air suction opening, in a radial direction; a motor that drives the centrifugal fan; a motor mount plate positioned to be spaced apart from the cover plate, the motor being mounted on the motor mount plate; and at least two or more combining protrusions extending perpendicularly from the circumference of the motor mount plate so as to be combined with the cover plate.

The motor may be an outer rotor type motor.

A power line extend hole may be formed at the motor mount plate and the cover plate to allow a power line for supplying power to the motor to penetrate therethrough, and a power line accommodating groove may be formed on an outer surface of the combining protrusions.

To achieve the above object, in another aspect, a refrigerator having a cool air supplying fan motor assembly, includes: a cool air duct flow path formed at an inner side of a wall surface of the refrigerator; a cover plate having a cool air suction opening communicating with the cool air duct flow path and fixed on the wall surface of the refrigerator; a blowing unit combined with a rear surface of the cover plate and discharging cool air which has been sucked into the cool air suction opening to the cool air duct flow path; and an evaporator provided at one side of the wall surface where the cover plate is combined and generating cool air to be supplied to the cool air suction opening.

A blowing unit accommodating part, in which the blowing unit is accommodated, may be formed at the inner side of the wall surface of the refrigerator and communicate with the cool air duct flow path.

An orifice may be formed around the cool air suction opening to allow cool air to be smoothly sucked into the blowing unit.

An elastic member may be interposed between the cover plate and the inner side wall of the refrigerator.

The blowing unit may include: a centrifugal fan that discharges cool air, which has been sucked into the cool air suction opening, in a radial direction; a motor that drives the centrifugal fan; a motor mount plate positioned to be spaced apart from the cover plate, the motor being mounted on the motor mount plate; and at least two or more combining protrusions extending perpendicularly from the circumference of the motor mount plate so as to be combined with the cover plate.

The motor may be an outer rotor type motor.

A power line extend hole may be formed at the motor mount plate and the cover plate to allow a power line for supplying power to the motor to penetrate therethrough, and a power line accommodating groove may be formed on an outer surface of the combining protrusions.

According to the cool air supplying fan motor assembly and a refrigerator having the same, because the fan motor assembly can be configured to be compact, the capacity of the storage space of the refrigerator can be increased, and because the power line supplying power to the motor does not interfere with the flow of cool air, the cooling efficiency of the refrigerator can be enhanced and vibration noise can be minimized.

MODE FOR CARRYING OUT THE PREFERRED EMBODIMENTS

The cool air supplying fan motor assembly and a refrigerator having the same according to an embodiment of the present invention will now be described with reference to the accompanying drawings.

Figure 1:
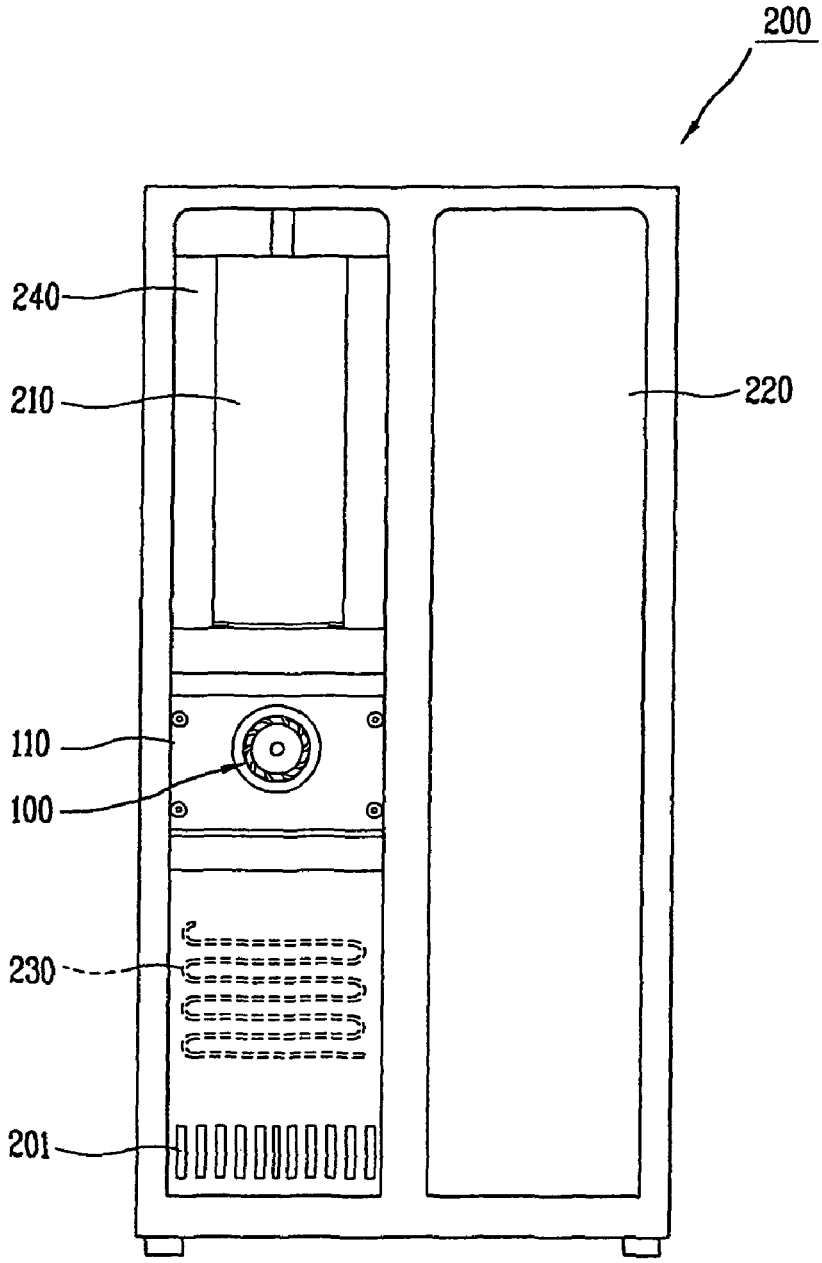
FIG. 1 is a front view of a refrigerator having a cool air supplying fan motor assembly according to an embodiment of the present invention.
Figure 2:
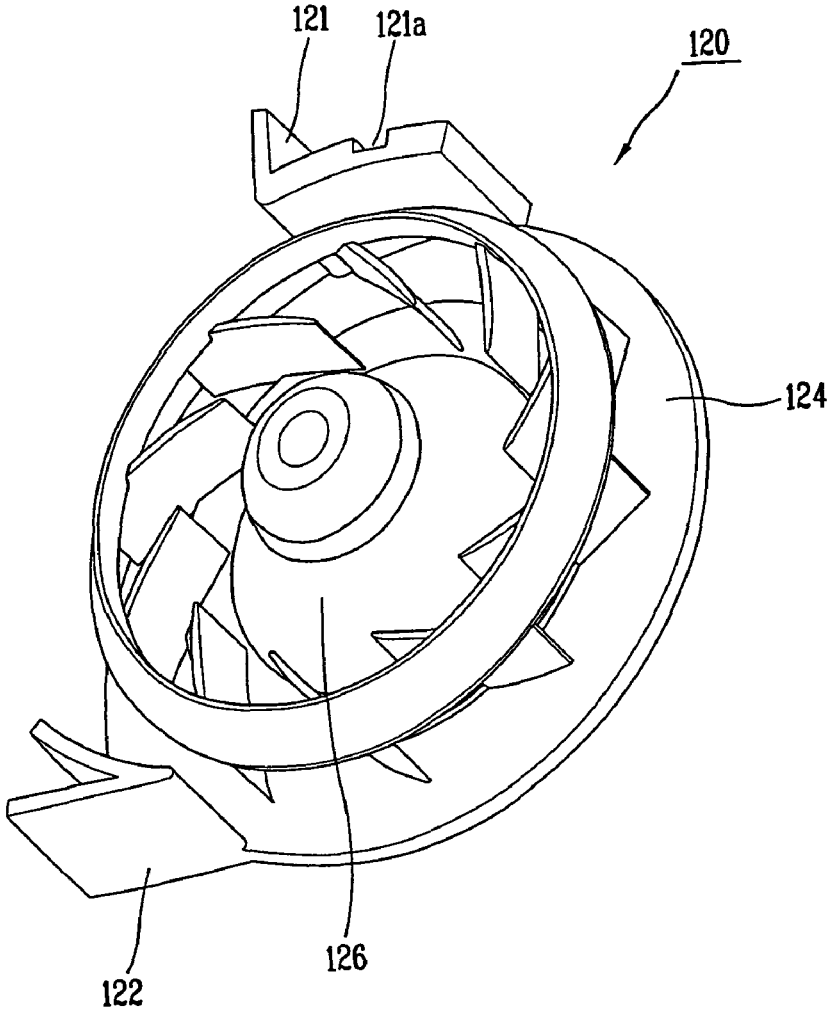
FIG. 2 is a perspective view showing a cool air supplying fan motor assembly according to the embodiment of the present invention.
Figure 3:
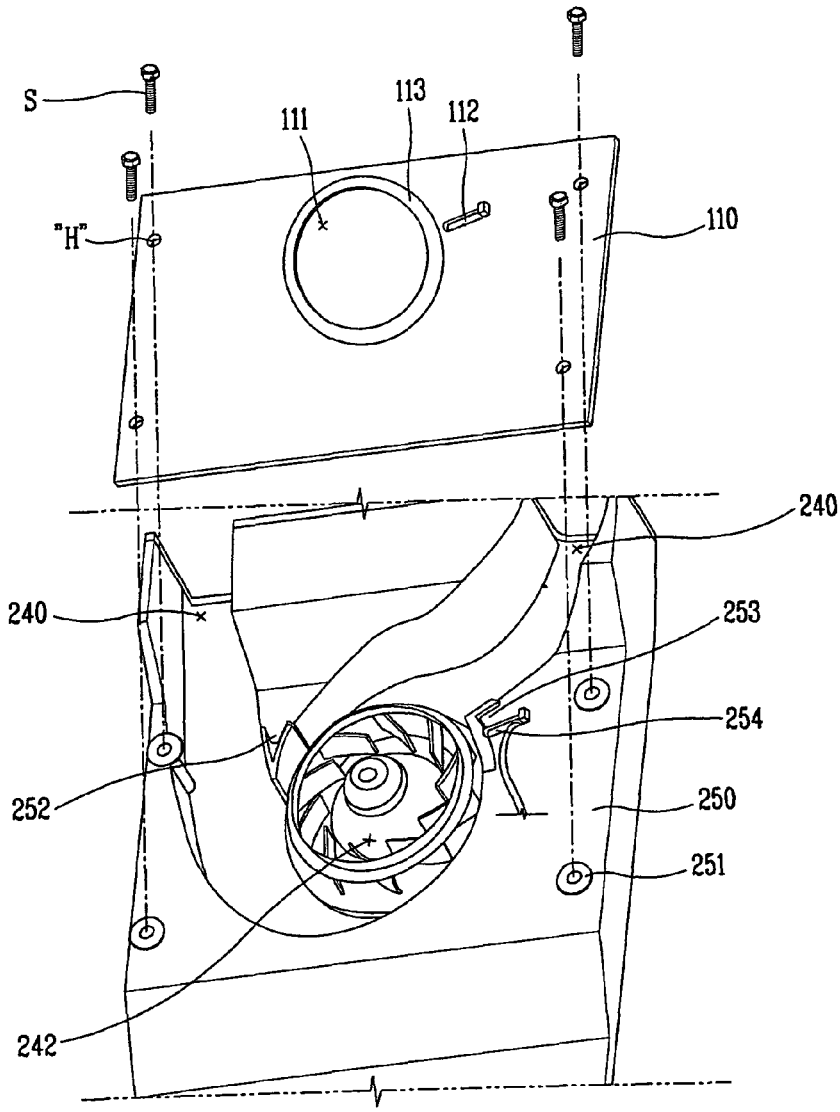
FIG. 3 is a front perspective view showing a cool air supplying fan motor assembly installed in a flow path of a cool air duct of a refrigerator according to the embodiment of the present invention.
Figure 4:
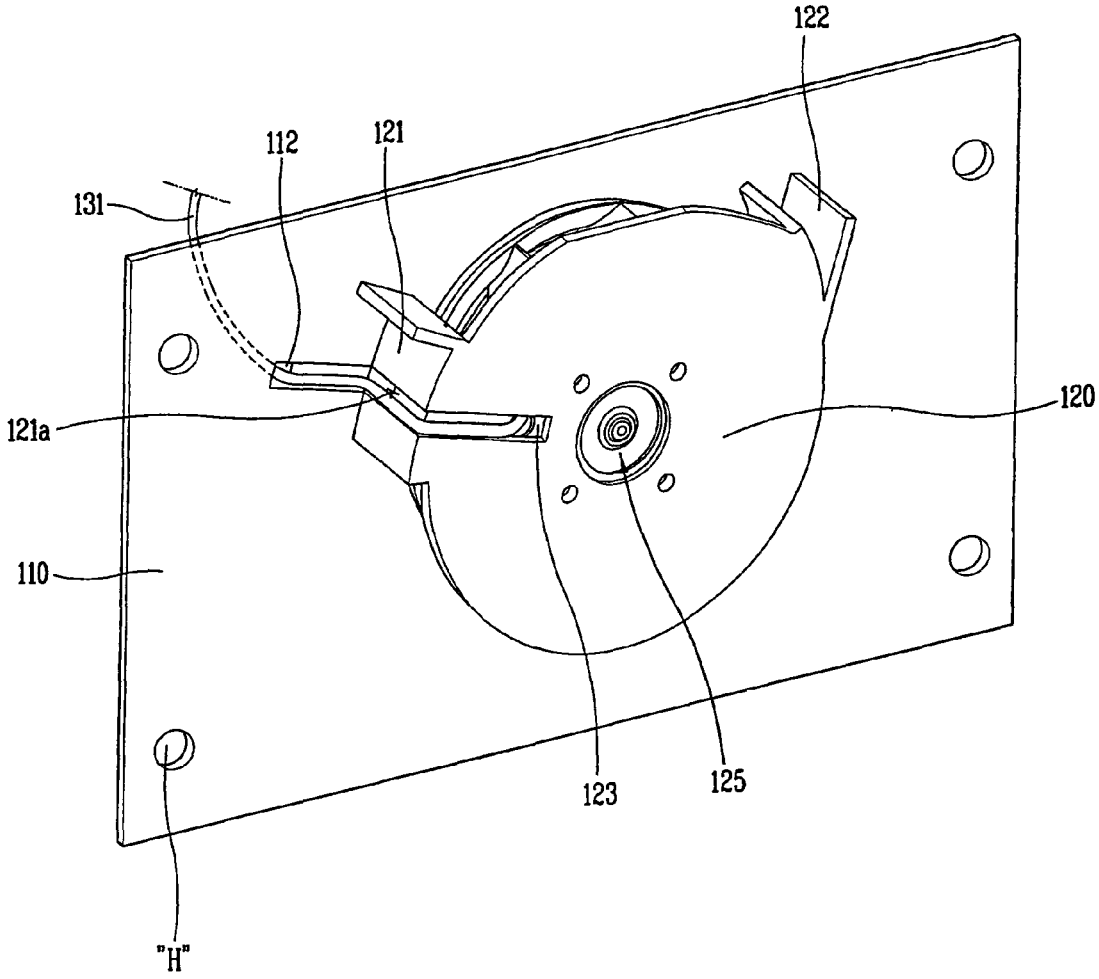
FIG. 4 is a rear perspective view showing the cool air supplying fan motor assembly installed in the flow path of the cool air duct of the refrigerator according to the embodiment of the present invention.

FIG. 1 is a front view of a refrigerator having a cool air supplying fan motor assembly according to an embodiment of the present invention, FIG. 2 is a perspective view showing a cool air supplying fan motor assembly according to the embodiment of the present invention, FIG. 3 is a front perspective view showing a cool air supplying fan motor assembly installed in a flow path of a cool air duct of a refrigerator according to the embodiment of the present invention, and FIG. 4 is a rear perspective view showing the cool air supplying fan motor assembly installed in the flow path of the cool air duct of the refrigerator according to the embodiment of the present invention.

As shown in FIGS. 1 to 4, a refrigerator 200 having a cool air supplying fan motor assembly according to an embodiment of the present invention includes evaporators 230 installed in a freezing chamber 210 and a refrigerating chamber 220, a cool air duct flow path 240 formed at an inner wall of the refrigerator to supply cool air to the refrigerating chamber 220 or the freezing chamber 220; a cool air fan motor assembly 100 that supplies cool air to the cool air duct flow path 240, and an elastic member 251 such as rubber interposed between the wall surface 250 of the refrigerator where the cool air duct flow path 240 is formed and a cover plate 110 of the cool air supplying fan motor assembly 100.

Here, the evaporator 230 is provided at one side of the wall surface where the cover plate is combined. Namely, the evaporator 230 is positioned on the substantially same planar surface of the cool air supplying fan motor assembly. Accordingly, compared with the case where the evaporator 230 is positioned at the front side of the fan motor assembly, the capacity of the storage space of the refrigerator can be increased.

In addition, in order to increase the efficiency of heat exchanging with air that passes through the evaporator 230, the evaporator 230 is configured such that air can pass therethrough in a lengthwise direction of the evaporator.

Here, reference numeral 201 denotes an air inlet through which air is introduced to the evaporator 230 from the storage space of the refrigerator, and the cool air supplying fan motor assembly 100 is preferably formed as an outer rotor type fan motor assembly.

The cool air supplying fan motor assembly 100 includes the cover plate 110 having a cool air suction opening 111 communicating with the cool air duct flow path 240 formed at the inner side of the wall surface of the refrigerator and combined on the wall surface of the refrigerator, and a blowing unit 120 combined on a rear surface of the cover plate 110 and discharging cool air sucked through the cool air suction opening 111 to the cool air duct flow path 240.

The cover plate 110 includes the cool air suction opening 111 through which cool air generated from the evaporator 230 is sucked, and the cool air suction opening 111 communicates with the cool air duct flow path 240 formed at the inner side of the wall body of the refrigerator. Accordingly, the cover plate 110 is combined on the wall surface of the refrigerator where the cool air duct flow path 240 is formed.

The blowing unit 120 is combined on the rear surface of the cover plate 110 and induces a suction force to allow cool air to be sucked into the cool air suction opening 111 and allow the sucked cool air to be discharged to the cool air duct flow path 240. Thus, the blowing unit is installed such that its outlet communicates with the cool air duct flow path 240.

Preferably, the blowing unit 120 is configured such that the direction in which cool air is discharged through the blowing unit 120 and the direction in which the cool air duct flow path 240 is formed are the same.

For this purpose, preferably, a blowing unit accommodating part 242 that can accommodate the blowing unit 120 is installed on an inner portion of the wall surface of the refrigerator. In particular, the blowing unit accommodating part 242 is configured such that the area, of the wall surface of the refrigerator, which corresponds to the configuration of the blowing unit 120 retreats to allow the blowing unit 120 to be inserted therein. In addition, at least two or more cool air duct flow paths 240 are formed in a radial direction of the blowing unit accommodating part 242 and communicate with the blowing unit accommodating part 242.

Accordingly, the space where the blowing unit 120 and the cool air duct flow paths 240 are installed may be reduced, resulting in obtaining an effect that the installation space of the cool air supplying fan motor assembly can be reduced.

The cool air duct flow paths 240 is provided on the wall surface constituting the storage space of the refrigerator and supplies cool air supplied by the blowing unit 120 to the storage space through a cool air discharge hole (not shown) configured to discharge cool air to the storage space.

An orifice 113 is formed around the cool air suction opening 111 to allow cool air to be smoothly sucked and reduce noise generated when cool air is sucked. The orifice 113 is configured such that the circumference of the cool air suction opening 111 faces the direction in which cool air is introduced, namely, the circumference of the cool air suction opening 111 protrudes front a front surface of the cover plate 110 and its section has a semi-circular shape or a streamline shape in order to reduce a flow resistance of cool air being sucked.

In particular, in the refrigerator 200 having the cool air supplying fan motor assembly according to the embodiment of the present invention, because the evaporator 230 is positioned on the substantially same planar surface on which the cool air supplying fan motor assembly is positioned, the flow of cool air sucked to the cool air suction opening 111 after passing through the evaporator 230 is a flow that changes its direction substantially at a right angle as mentioned above, so the effect of the reduction of the flow resistance and noise can considerably vary according to presence or absence of the orifice 113.

In combining the cover plate 110 on the wall surface 250 of the wall body of the refrigerator where the cool air duct flow path 240 is formed, the elastic members 251 are interposed between the wall surface 250 of the wall body of the refrigerator and the cover plate 110.

With such configuration, vibration and noise transferred to the cover plate 110 after being generated from the blowing unit 120 combined on the rear surface of the cover plate 110 can be minimized.

Here, preferably, the elastic members 251 may be formed of a thin plate having a ring or washer shape at four positions where screws (S) are fastened. Reference letter 'H' in FIG. 3 denotes a screw hole.

Meanwhile, the blowing unit 120 includes a centrifugal fan 126 that discharges cool air, which has been sucked through the cool air suction opening 111, in a radial direction, a motor 125 that drives the centrifugal fan 126, a motor mount plate 124 positioned to be spaced apart from the cover plate 110, the motor 125 being mounted on the motor mount plate 124, and at least two or more combining protrusions 121 and 122 extending perpendicularly from the circumference of the motor mount plate 124 and combined with the cover plate 110.

The combining protrusions 121 and 122 are configured to combine the blowing unit 120 to the rear surface of the cover plate 110.

In addition, counter units 252 and 253 are configured at the blowing unit accommodating part 242, to which the combining protrusions 121 and 122 are fixed to prevent the blowing unit 120 from moving within the blowing unit accommodating part 242.

The number of the combining protrusions 121 and 122 is determined according to the number of cool air duct flow paths 240 configured from the blowing unit accommodating part 242. Namely, as shown in FIG. 3, the combining protrusions 121 and 122 are formed by the number corresponding to the number of the cool air duct flow paths 240.

Meanwhile, power line extend holes 123 and 112 are formed at the motor mount plate 124 and the cover plate 110 to allow a power line 131 that provides power to the motor to penetrate therethrough.

Here, the power line extend hole 112 fanned at the cover plate 110 is formed at one of positions where the multiple combining protrusions 121 and 122 are combined.

In addition, a power line accommodating groove 121*a* is formed at one outer surface of the multiple combining protrusions 121 and 122.

A power line insertion groove 254 may be formed at one of the counter units 252 and 253 formed at the blowing unit accommodating part 242 in order to allow the power line 131 which has drawn out of the rear surface of the motor mount plate 124 to pass therethrough.

Thus, because the power line 131 connected with the motor 125 drawn out of the front surface of the cover plate 110 through the power line extend holes 112 and 123, it does not interfere with the flow of cool air flowing through the cool air duct flow path 240.

INDUSTRIAL APPLICABILITY

The operation and effect of the cool air supplying fan motor assembly and the refrigerator having the cool air supplying fan motor assembly according to the embodiment of the present invention constructed as described above will now be explained.

In the cool air supplying fan motor assembly 100 according to the embodiment of the present invention, the blowing unit 120 having the motor 125 and the fan 126 mounted on the motor mount plate 124 is combined with the cover plate 110, and the cover plate 110 is fixed on the wall surface where the cool air duct flow path 240 is formed at the inner side of the wall body of the refrigerator. In addition, the fan 126 constituting the blowing unit 120 is formed as the centrifugal fan to discharge cool air to the cool air duct flow path 240 formed in the radial direction. Accordingly, the cool air supplying fan motor assembly according to the embodiment of the present invention is formed as a single product, namely, a module, comprising several components, whereby the installation space can become compact and the capacity of the storage space of the refrigerator can be increased.

In addition, in the cool air supplying fan motor assembly 100 according to the embodiment of the present invention, when the user applies power to the motor 125, the fan 126 connected with the rotor (not shown) of the motor 125 is rotated. At this time, air sucked through the air inlet 201 is changed to cool air by the evaporator 230, introduced into the cool air suction according to the rotation of the fan 126, discharged in the radial direction of the fan 126, and then guided to the cool air duct flow path 240. In this case, the power line 131 connected with the motor 125 extends through the power line extend hole 123 of the motor mount plate 124, the power line insertion groove 254 formed at the blowing unit accommodating part 242 or through the power line accommodating groove 121 a formed on the outer surface of one of the multiple combining protrusions 121 and 122, and the power line extend hole 112 of the cover plate 110. Thus, when cool air is guided along the cool air duct flow path 240, the power line 131 never interferes with the cool air.

In addition, when the motor 125 is operated, vibration and noise is inevitably generated. In this case, because the cover plate 110 is combined on the wall surface 250 of the refrigerator by using the four elastic members 251 provided at certain positions, the vibration and noise caused by the motor 125 can be effectively reduced.

The invention claimed is:

1. A fan motor assembly for a refrigerator, comprising:

a cover plate having a suction opening formed therein;

at least one air duct flow path formed at an inner side of a wall surface of the refrigerator; and a blower coupled to a rear surface of the cover plate and received in an accommodating part formed in the inner side of the wall surface of the refrigerator so as to be in communication with the at least one air duct flow path, wherein the blower directs air which has been drawn in through the air suction opening to the at least one air duct flow path, wherein the blower comprises:

a centrifugal fan including blades that discharges air, which has been drawn in through the air suction opening, in a radial direction;

a motor mount plate positioned a predetermined distance from the cover plate so as to form a space between the cover plate and the motor mount plate;

a motor mounted on a surface of the motor mounting plate facing the cover plate and positioned in the space formed between the cover plate and the motor mount plate;

at least two combining protrusions that extend perpendicularly from respective peripheral edge portions of the motor mount plate toward the cover plate so as to couple the motor mount plate and the cover plate and maintain the predetermined distance between the mounting plate and the cover plate, wherein the at least two combining protrusions are positioned along at least a portion of a circumferential arc encircling the blades;

power line holes respectively formed in the motor mount plate and the cover plate to allow a power line for supplying power to the motor to penetrate through the motor mount plate and the cover plate via the power line holes; and a power line accommodating groove formed in an outer surface of at least one of the at least two combining protrusions; and at least one elastic member positioned between mating surfaces of the cover plate and the inner side of the wall surface of the refrigerator, wherein the at least one elastic member transfers vibration generated by the fan and motor received in the accommodating part to the cover plate.

2. The fan motor assembly of claim 1, further comprising an orifice formed around the air suction opening to allow air to be smoothly sucked into the blower.

3. The fan motor assembly of claim 1, wherein the air suction opening directs cool air generated by an evaporator provided at one side of the wall surface on which the cover plate is coupled toward the blower.

4. The fan motor assembly of claim 1, wherein the motor is an outer rotor motor.

5. The fan motor assembly of claim 1, wherein the accommodating part and the at least one air duct flow path comprise recesses formed in the wall surface of the refrigerator, the recesses extending away from an interior of the refrigerator.

6. The fan motor assembly of claim 5, wherein an outer peripheral portion of the cover plate extends beyond an outer periphery of the motor mount plate, with the outer peripheral portion of the cover plate coupled to the wall surface of the refrigerator so as to suspend the blower in the accommodating part.

7. A refrigerator having a cool air supplying fan motor assembly, comprising:

a cool air duct flow path formed at an inner side of a wall surface of the refrigerator;

a cover plate fixed to the wall surface of the refrigerator and having a cool air suction opening formed therein in communication with the cool air duct flow path;

a blower coupled to a rear surface of the cover plate and accommodated in a blower accommodating part formed in the inner side of the wall surface of the refrigerator so as to be in communication with the cool air duct flow path, wherein the blower directs cool air which has been drawn in through the cool air suction opening to the cool air duct flow path, wherein the blower comprises:

a centrifugal fan including blades that discharges cool air, which has been drawn in through the cool air suction opening, in a radial direction;

a motor mount plate positioned a predetermined distance from the cover plate so as to form a space between the cover plate and the motor mount plate;

a motor mounted on a surface of the motor mount plate facing the cover plate and positioned in the space formed between the cover plate and the motor mount plate;

at least two combining protrusions that extend perpendicularly from respective outer peripheral edge portions of the motor mount plate so as to couple the motor mount plate and the cover plate and maintain the predetermined distance between the cover plate and the motor mount plate, wherein the at least two combining protrusions are positioned along at least a portion of a circumferential arc encircling the blades;

power line holes respectively formed in the motor mount plate and the cover plate to allow a power line for supplying power to the motor to penetrate through the motor mount plate and the cover plate via the power line holes; and a power line accommodating groove formed in an outer surface of at least one of the at least two combining protrusions; and at least one elastic member provided between the cover plate and the inner side of the wall surface of the refrigerator, wherein the at least one elastic member transfers vibration generated by the fan and motor received in the accommodating part to the cover plate; and an evaporator provided at one side of the wall surface at which the cover plate is coupled, wherein the evaporator generates cool air to be supplied to the cool air suction opening.

8. The refrigerator of claim 7, further comprising an orifice formed around the cool air suction opening to allow cool air to be smoothly drawn into the blower.

9. The refrigerator of claim 7, wherein the motor is an outer rotor motor.

10. The refrigerator of claim 7, wherein the accommodating part comprises a recess formed in the wall surface of the refrigerator that extends away from an interior of the refrigerator, and wherein an outer peripheral portion of the cover plate extends beyond an outer periphery of the motor mount plate, with the outer peripheral portion of the cover plate coupled to the wall surface of the refrigerator so as to suspend the blower in the accommodating part.

11. A fan motor assembly for a refrigerator, comprising:

a cover plate having a suction opening formed therein, wherein the cover plate is configured to be coupled to an interior wall of a refrigerator so as to form a receiving space between the cover plate and a recess formed in the interior wall of the refrigerator;

a blower received in the receiving space so as to be in communication with a plurality of cooling air flow paths formed at the interior wall of the refrigerator, wherein the blower directs air which has been drawn in through the air suction opening to the plurality of cooling air flow paths, wherein the blower comprises:

a centrifugal fan including blades;

a motor that drives the fan;

a motor mount plate having the motor mounted thereon, the motor mount plate being coupled to the cover plate and spaced apart from the cover plate such that the motor is positioned between the motor mount plate and the cover plate;

at least two protrusions that extend from an outer portion of a mounting surface of the motor mount plate toward the cover plate, wherein the at least two protrusions align the motor and fan coupled thereto on the motor mount plate, wherein the at least two protrusions are positioned along at least a portion of a circumferential arc encircling the blades;

power line holes formed in each of the motor mount plate and the cover plate; and a power line groove formed in an outer surface of one of the at least two protrusions, wherein a power line extends through the power line holes and along the power line groove to supply power to the motor; and at least one elastic member positioned between mating surfaces of the cover plate and the inner side of the wall surface of the refrigerator, wherein the at least one elastic member transfers vibration generated by the fan and motor received in the receiving space to the cover plate.

12. The fan motor assembly of claim 11, further comprising:

a plurality of first fastening holes formed in the cover plate;

a plurality of second fastening holes formed in the interior wall of the refrigerator, corresponding to the plurality of first fastening holes; and a plurality of fasteners that respectively extend through the plurality of first fastening holes and in to the plurality of second fastening holes to couple the cover plate to the interior wall of the refrigerator.

13. The fan motor assembly of claim 12, wherein the at least one elastic member comprises a plurality of deformable rings respectively arranged at mating surfaces of the cover plate and the interior wall of the refrigerator corresponding to peripheral portions of the plurality of first fastening holes and plurality of second fastening holes, with the plurality of screws extending respectively through the plurality of first fastening holes and the plurality of second fastening holes.

14. The refrigerator of claim 11, wherein an outer peripheral portion of the cover plate extends beyond an outer periphery of the motor mount plate, with the outer peripheral portion of the cover plate coupled to the interior wall of the refrigerator so as to suspend the blower in a recess formed in the interior wall of the refrigerator that defines the receiving space together with the cover plate.

* * * * *